US007862209B2

(12) United States Patent
Fitzgibbon et al.

(10) Patent No.: US 7,862,209 B2
(45) Date of Patent: Jan. 4, 2011

(54) PERMANENTLY INSTALLED LIGHT EMITTING ELEMENTS FOR A BARRIER OPERATOR

(75) Inventors: James J. Fitzgibbon, Batavia, IL (US); Keith Johnson, Orland Park, IL (US); David Thomas Mack, Naperville, IL (US); Robert J. Olmsted, Wood Dale, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 277 days.

(21) Appl. No.: 11/971,718

(22) Filed: Jan. 9, 2008

(65) Prior Publication Data

US 2009/0175025 A1 Jul. 9, 2009

(51) Int. Cl.
*F21V 29/00* (2006.01)

(52) U.S. Cl. ..... 362/294; 362/85; 362/246

(58) Field of Classification Search ..... 362/85, 362/147, 237, 246, 247, 294, 373; 340/5.7, 340/5.71, 815.45; 318/16, 280, 558
See application file for complete search history.

(56) References Cited

U.S. PATENT DOCUMENTS 2,901,596 A * 8/1959 Bell et al. ..... 362/311.04
6,847,303 B2 * 1/2005 Hoermann ..... 318/16
6,982,652 B2 1/2006 Laird et al.
7,145,470 B2 12/2006 Hoermann
2003/0214806 A1 11/2003 Laird et al.
2006/0232937 A1 * 10/2006 Song et al. ..... 362/373
2008/0174993 A1 7/2008 Hsieh et al.

FOREIGN PATENT DOCUMENTS

DE 20200500034 U1 7/2005
EP 1 988 245 5/2008
JP 2007242711 9/2007
WO WO 2006/138246 12/2006

OTHER PUBLICATIONS

Search Report Under Section 17; British Application No. GB0822108.7; Dated: Mar. 19, 2009.

* cited by examiner

*Primary Examiner*—Y My Quach Lee
(74) *Attorney, Agent, or Firm*—Fitch, Even, Tabin & Flannery

(57) ABSTRACT

A barrier movement operator controls movement of a movable barrier. The barrier movement operator includes a head unit, including a chassis, for commanding the movable barrier to perform movable barrier functions. A plurality of closely mounted light emitting elements are fixedly mounted onto the head unit. A heat sink is in thermal communication with the set of light emitting elements and with the chassis of the barrier movement operator to dissipate thermal energy from the set of light emitting elements. A controller is utilized for controlling the head unit to provide power to the set of light emitting elements.

21 Claims, 4 Drawing Sheets

PERMANENTLY INSTALLED LIGHT EMITTING ELEMENTS FOR A BARRIER OPERATOR

TECHNICAL FIELD

This invention relates generally to movable barrier operators and more particularly to movable barrier operators having lighting.

BACKGROUND

One of the most basic auxiliary features of a movable barrier operator is the control of lighting in a garage. Over the years, the lighting has been provided by an incandescent lamp installed on the movable barrier operator. In Europe, both line voltage and low voltage incandescent lamps are used. More recently, lamps using other technologies have come into interest. With incandescent lamps, the system requires the ability for the lamp to be replaced due to its low life expectancy.

Replacing lights in a movable barrier operator can be problematic. For example, movable barrier operators are often located high enough above the ground that a person must stand on a ladder to reach the movable barrier operator. Moreover, the use of a socket, as is required with incandescent light bulbs, can require additional wiring and space within the movable barrier operator due to the variations in light bulbs from different manufacturers. Movable barrier operators that use light bulbs having a short lifetime typically need to have sections that can be opened or otherwise moved. For example, a user might have to open a cover to access a light socket to replace a burnt out light bulb. The manufacture and assembly of movable barrier operators having such movable parts relating to light sockets can be complex and extra precision may be required during manufacture and assembly to ensure that the various movable parts fit properly together.

There is a movable barrier system in the art that utilizes incandescent lamps with movable shields in order to direct the light generated by the lamps. The incandescent lamps can be replaced because the shield does not completely cover the lamp. The shield is permanently attached to the movable barrier operator, although it is movable.

Another movable barrier in the art utilizes light emitting diodes ("LEDs") that are mounted onto a metal plate to dissipate heat generated by the LEDs. However, this system can overheat due to the power required to get adequate lighting, when a large number of LEDs (as may be useful or necessary to ensure the provision of a suitable quantity of light) are mounted onto the heat plate, resulting in subpar performance that may damage some of the LEDs.

SUMMARY OF THE INVENTION

An embodiment of the present invention is directed a barrier movement operator for controlling movement of a movable barrier. A head unit includes a chassis and commands the movable barrier to perform movable barrier functions. A plurality of closely mounted light emitting elements is fixedly mounted onto the head unit. A heat sink is in thermal communication with the set of light emitting elements and with the chassis of the barrier movement operator to dissipate thermal energy from the set of light emitting elements. A controller is utilized to control the head unit to provide power to the set of light emitting elements.

By one approach, the light emitting elements may be closely mounted to one another to generate a bright light source. This can be useful when the light emitting elements are LEDs, as they may each individually produce a bright point of light that by itself might not provide sufficient light to illuminate a garage or other enclosure in which the movable barrier operator is mounted. A combination of a plurality of close mounted light emitting elements, however, can be sufficient to illuminate such a space. Furthermore, in the event that one of the light emitting elements malfunctions or is otherwise faulty, a bright beam of light can still be produced by the other adjacent light emitting elements.

These teachings will accommodate the use of light emitting elements that are of the type that are long-lasting and do not require a socket. By using long-lasting socket-less light emitting elements, such light emitting elements can be fixedly or permanently installed in the movable barrier operator. Using such permanently installed light emitting elements can provide numerous benefits. For example, manufacture and assembly of the movable barrier operator may be easier because certain movable parts are not required because there is no need to periodically change the light emitting elements.

The use of closely mounted light emitting elements may generate a relatively substantial amount of heat that can adversely affect the functioning of the light emitting elements. By one approach, the light emitting elements can be mounted onto a plate that serves, in turn, to dissipate such thermal energy. If desired, the plate itself can be in thermal communication with the chassis of the movable barrier operator to further dissipate the heat generated by the light emitting elements. So configured, the chassis can aid in dissipating enough heat to ensure proper operation of the light emitting elements.

These teachings will accommodate an embodiment that is directed to a barrier movement operator for controlling movement of a movable barrier. A head unit of such an operator can comprise a chassis and can serve to command a given movable barrier to perform movable barrier functions. In this illustrative example a plurality of Light Emitting Diodes are fixedly mounted onto the head unit. A diffuser can then be fixedly mounted on the head unit to spread light generated by the set of light emitting elements. A controller can be utilized for controlling the head unit to provide power to the set of light emitting elements.

These teachings will also accommodate a method of controlling the provision of power to a plurality of Light Emitting Diodes that are closely and fixedly mounted on a chassis of a head unit of a movable barrier operator that controls movement of a movable barrier. The movable barrier is commanded to perform movable barrier functions. Power is provided to the plurality of Light Emitting Diodes. Thermal energy produced by the plurality of Light Emitting Diodes is dissipated via the chassis. The head unit is controlled to provide power to the plurality of Light Emitting Diodes.

The above summary of the present invention is not intended to represent each embodiment or every aspect of the present invention. The detailed description and Figures will describe many of the embodiments and aspects of the present invention.

BRIEF DESCRIPTION OF THE DRAWINGS

The above needs are at least partially met through provision of the method and apparatus for remote control described in the following detailed description, particularly when studied in conjunction with the drawings, wherein.

Figure 1:
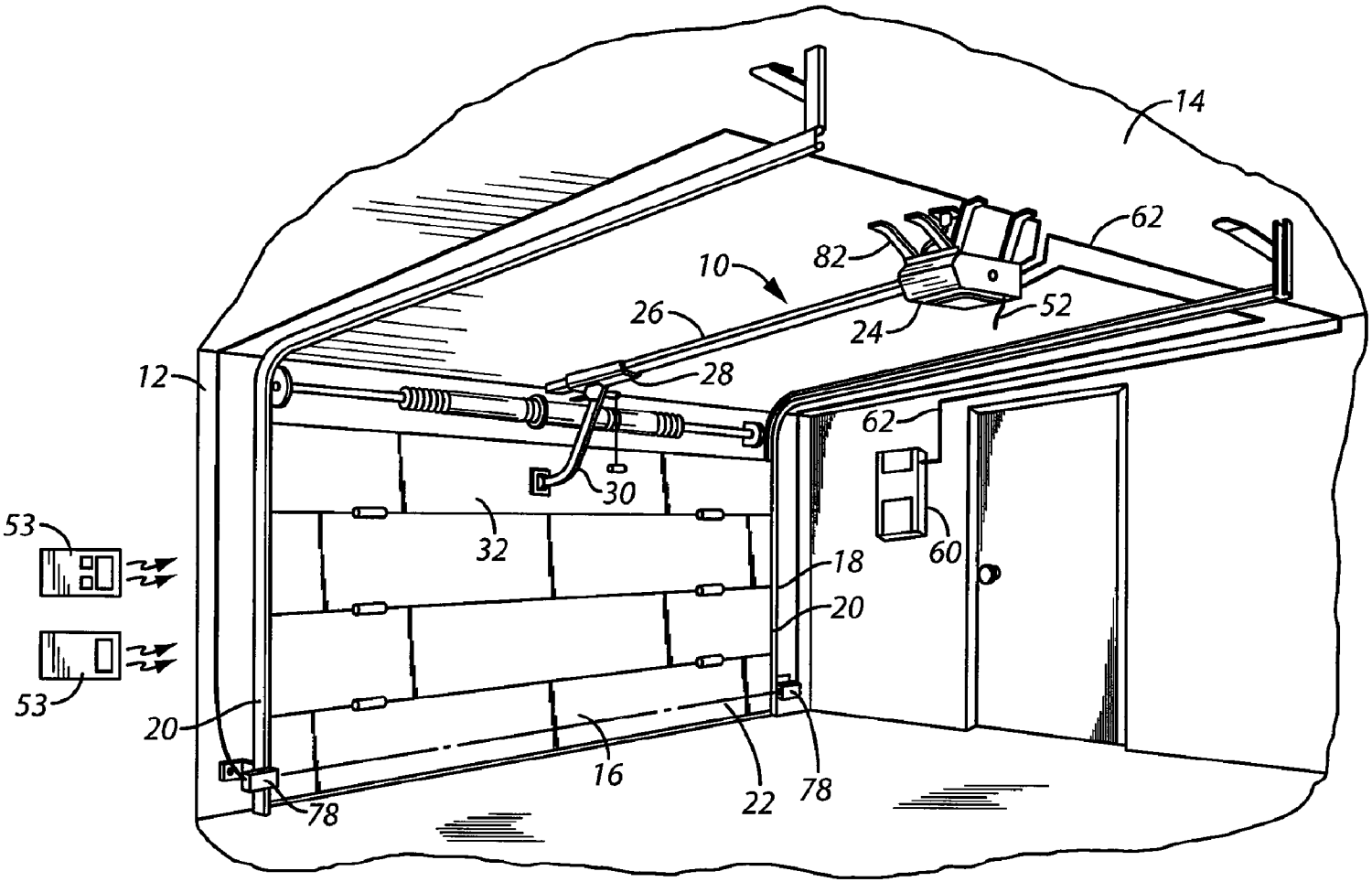
FIG. 1 illustrates a movable barrier operator according to an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are typically not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to the field of the invention and their corresponding respective areas of inquiry and study except where specific meanings have otherwise been set forth herein.

DETAILED DESCRIPTION

At least one embodiment of the invention is directed to the use of one or more permanently installed light emitting elements for a movable barrier operator. The permanently installed light emitting elements may include light emitting diodes ("LEDs") or other durable and long-lasting light producing elements. Such LEDs may be expected to have a life expectancy that exceeds that of the movable barrier operator onto which they are installed for many normal application settings.

The use of permanently installed light emitting elements installed within the movable barrier operator affects not only the mounting of the lights themselves, but also the device used to spread the light used in the systems. In a normal movable barrier operator, a light diffuser must be removed or opened whenever a light bulb is being replaced. However, in embodiments discussed below, the diffuser may also be permanently installed.

The permanently installed lights, as discussed herein, include light emitting elements not requiring use of a socket. Sockets are utilized in lighting systems utilizing incandescent light bulbs or other elements that generally have a shorter lifespan than the movable barrier operators into which they inserted. Because the light emitting elements discussed herein have a very long lifespan, they are permanently installed so that they do not need to be replaced. As used herein, then, it will be understood that the expression "permanently installed" or the like refers to an installation that is hardwired and that is effected without the use of a socket or other physical fixture that serves and is intended to serve as a means of permitting anticipated removal, by hand, of a failed light emitting element.

There are a variety of different locations onto which the light emitting elements may be mounted. By one approach, the light emitting elements may be distributed around the body of the movable barrier operator to create an even distribution of light around an enclosure within which the movable barrier operator is mounted, such as a garage.

In some embodiments, bright point sources of light, such as those produced by LEDs, can be irritating to one's eyes. Accordingly, because the point sources are so intense it is beneficial to spread light from the sources out at the movable barrier operator. There are many ways by which to spread the light from point sources. Various reflector, diffusers, and lenses may be used to spread the light, as discussed below with respect to FIGS. 3-7.

The use of closely mounted light emitting elements may generate a relatively substantial amount of heat that can adversely affect the functioning the light emitting elements. By one approach, then, the light emitting elements are mounted onto one or more heat sinks, such as a plate or plates, to dissipate the thermal energy. The heat sink can itself be in thermal communication with the chassis of the movable barrier operator to further dissipate the heat generated by the light emitting elements. The chassis dissipates enough heat to ensure proper operation of the light emitting elements.

So configured, those skilled in the art will recognize and appreciate that these teachings permit the use of permanently installed light emitting elements with movable barrier operators in an effective manner that ensures both adequate lighting results while also ensuring suitable operating conditions for the light emitting elements themselves. This, in turn, permits the movable barrier operator to be designed and manufactured with simpler form factors and fewer moving parts to thereby achieve higher quality products at lower costs. These teachings also avoid the need for occasional replacement of the light emitting elements and therefore free the end user from this maintenance activity.

These and other benefits may become clearer upon making a thorough review and study of the following detailed description. Referring now to drawings and especially to FIG. 1, an illustrative example of a movable barrier operator is shown therein. Those skilled in the art will appreciate and recognize that the use of such an example is intended to serve only as an illustrative example and is not intended to serve as an exhaustive or otherwise limiting example in this regard.

The movable barrier operator, in this embodiment a garage door operator 10, is positioned within a garage 12. More specifically, it is mounted to a ceiling 14 of the garage 12 for operation, in this embodiment, of a multipanel garage door 16. The multipanel garage door 16 includes a plurality of rollers 18 rotatably confined within a pair of tracks 20 positioned adjacent to and on opposite sides of an opening 22 for the garage door 16.

The garage door operator 10 also includes a head unit 24 for providing motion to the garage door 16 via a rail assembly 26. The head unit 24 is attached to a chassis 82 of the garage door operator 10. This chassis is usually a metal which covers the entire top surface of the operator. The rail assembly 26 includes a trolley 28 for releasable connection of the head unit 24 to the garage door 16 via an arm 30. The arm 30 is connected to an upper portion 32 of the garage door 16 for opening and closing it. The trolley 28 is connected to an endless chain to be driven thereby. The chain is driven by a sprocket in the head unit 24. The sprocket acts as a power takeoff for an electric motor located in the head unit 24.

Figure 2:
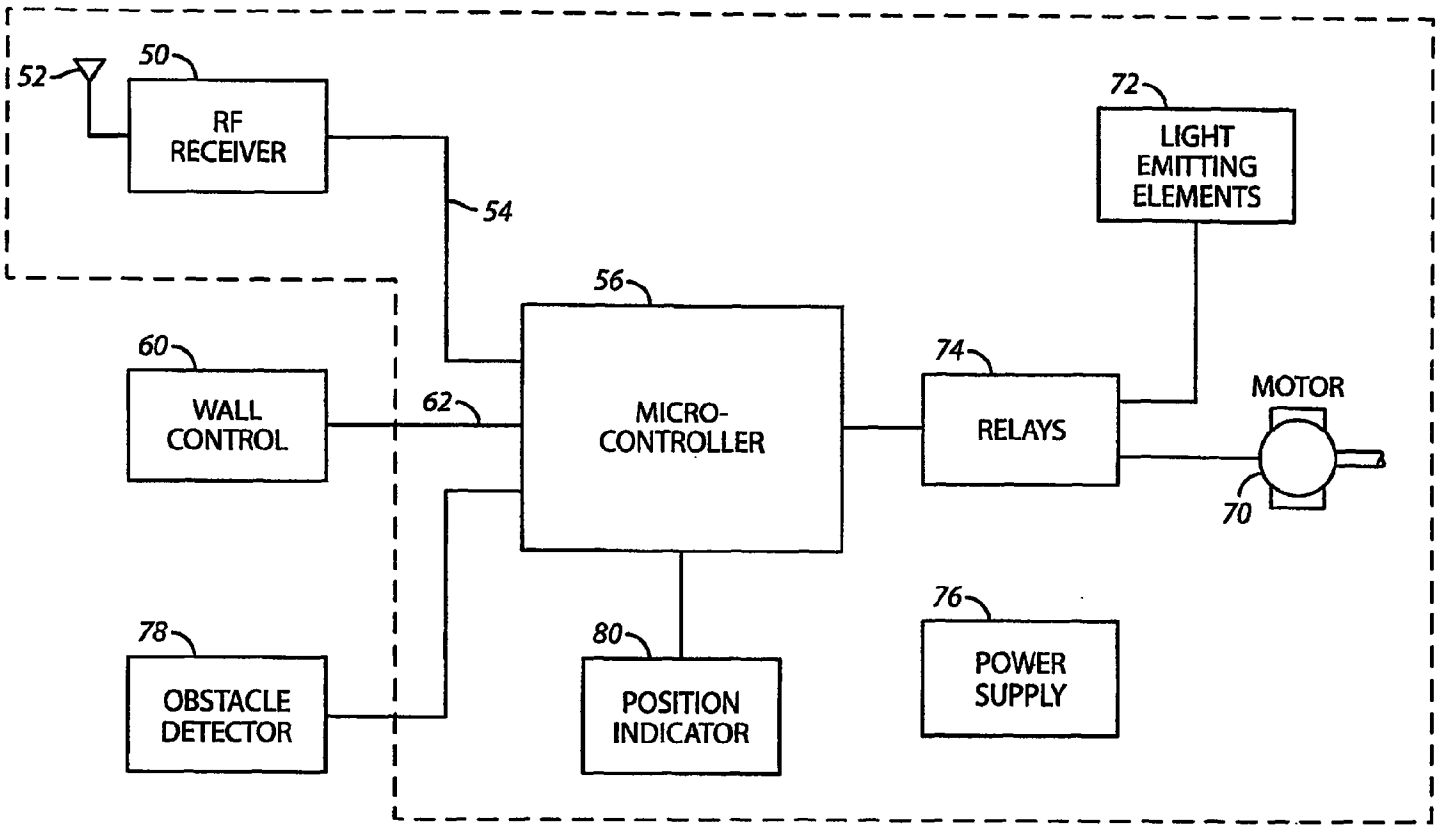
FIG. 2 illustrates a head unit of the movable barrier operator according to an embodiment of the invention.

The head unit 24 includes a radio frequency receiver 50, as may best be seen in FIG. 2, having an antenna 52 associated with it for receiving coded radio frequency transmissions from one or more radio transmitters 53 which may include portable or keyfob transmitters or keypad transmitters. The radio receiver 50 is connected via a line 54 to a microcontroller 56 which interprets signals from the radio receiver 50 as code commands to control other portions of the garage door operator 10.

A wall control unit 60 communicates over a line 62 with the head unit microcontroller 56 to effect control of a garage door operator motor 70 and light emitting elements 72 via power control logic 74 connected to the microcontroller 56. The power control logic can control the lighting of the light emitting elements in groups or independently as desired. The entire head unit 24 is powered from a power supply 76. In addition, the garage door operator 10 includes an obstacle detector 78, which optically or via an infrared pulsed beam detects when the garage door opening 22 is blocked and signals the microcontroller 56 of the blockage. The microcontroller 56 then causes a reversal or opening of the door 16. In addition, a position indicator 80 indicates to the head unit microcontroller 56, through at least part of the travel of the door 16, the door position so that the microcontroller 56 can control the close position and the open position of the door 16 accurately.

Figure 3:
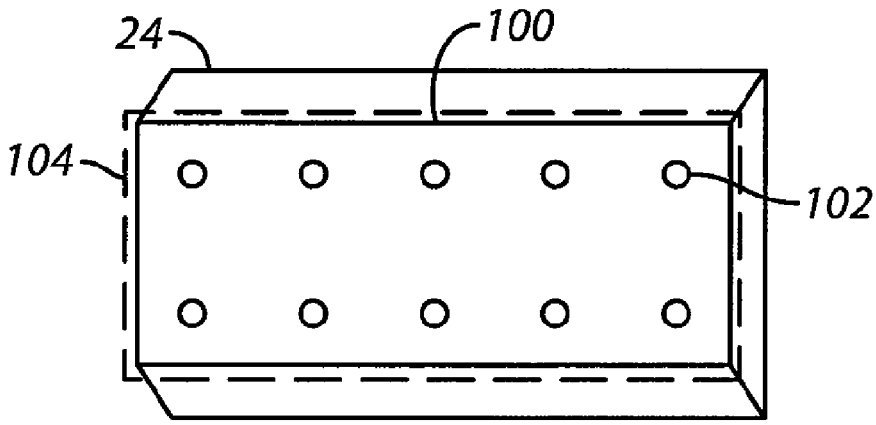
FIG. 3 illustrates a bottom view of the head unit of movable barrier operator according to an embodiment of the invention.

FIG. 3 illustrates a bottom view of the head unit 24 of the movable barrier operator 10 according to one illustrative example. As shown, the head unit 24 includes a heat sink such as a plate 100 or other element onto which a plurality of light emitting elements 102, such as LEDs are mounted. The light emitting elements 102 are permanently installed onto the plate 100. For example, the light emitting elements 102 may be installed onto the plate 100 when it is assembled at a factory. The plate 100 may also be mounted onto the head unit 24 at the factory during the manufacturing process. By pre-assembling the plate 100 with the permanently/fixedly mounted light emitting elements 102, the head unit 24 may be quickly and easily installed at a consumer's garage or other enclosure.

The plate 100 may be formed of a thermally conductive material such as a metal. Those skilled in the art will recognize that a variety of possibilities exist in this regard. Some illustrative examples would comprise, but are not limited to, aluminum and aluminum alloys, copper, and so forth. The light emitting elements 102 may generate enough heat such that the generated heat must be dissipated to avoid damaging the light emitting elements 102. The plate 100 absorbs/dissipates heat generated by the light emitting elements 102. It would also be possible to use more than one plate to accommodate, for example, differing form factor requirements as correspond to a given application setting.

In this illustrative example the plate 100 is in thermal communication with a chassis 82 of the movable barrier operator 10 to further dissipate the heat away from the light emitting elements, as shown in FIG. 1. For example, the plate 100 may be physically joined with a metal chassis 82 to further draw the heat away from the light emitting elements 102. This thermal connection can also be preformed by utilizing heat pipes (which are sealed tubes containing liquid that travels in a vapor phase to a cooler side of the component where the substance then condenses to repeat the process and are often used as computer heatsinks). By using a thermal coupling to the chassis 82, a relatively large amount of heat may be dissipated, resulting in efficient operation of the light emitting elements 102.

FIG. 3 illustrates an embodiment in which ten light emitting elements 102 have been evenly spaced along the plate 100, and which face generally downwardly when the head unit 24 is mounted onto a ceiling of a garage or other enclosure. Many light emitting elements 102, such as LEDs, generate a bright point of light that may be irritating or distracting to a driver or other person utilizing the movable barrier operator. Accordingly, a diffuser 104 may optionally be placed at the bottom of the head unit 24 to diffuse the bright points of light generated by the light emitting elements mounted on the plate 100. The diffuser 104 may have a creamy white color in some embodiments. In other embodiments the diffuser may be tinted to modify the color of the light and in still other embodiments the diffuser can be clear albeit with controlled imperfections (such as bubbles in the plastic). The diffuser 104 is shown with dashed lines in FIG. 3. It may be noted that, when provided, this diffuser can be essentially permanently installed such that hinges, latches, and other end-user manipulable mechanisms need not be provided as there is no particular need to provide end-user access to the permanently installed light emitting element.

The diffuser may be mounted above the Light Emitting Diodes and to direct the light in a general direction away from of the Light Emitting Diodes. A second diffuser may be included and mounted below the Light Emitting Diodes to direct the light in a general direction away from the Light Emitting Diodes. The diffuser may also be mounted below the Light Emitting Diodes to direct the light in a general direction away from the Light Emitting Diodes.

Figure 4:
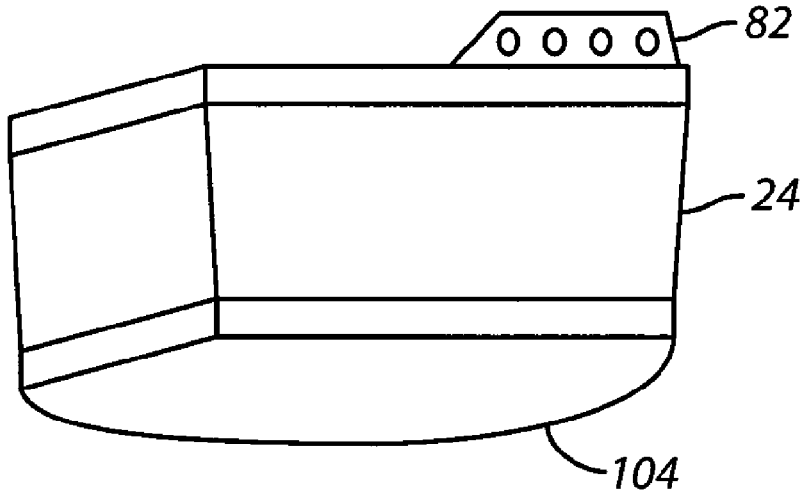
FIG. 4 illustrates a side view of the head unit according to an embodiment of the invention.

FIG. 4 illustrates a side view of the head unit 24 according to an embodiment of the invention. The chassis 82 may be utilized to mount the head unit 24 onto the ceiling of other surface of a garage or other enclosure. Although not shown in this view, the plate 100 illustrated in FIG. 3 is in thermal communication with the chassis 82 to draw heat away from the light emitting elements 102 generating the heat. The chassis 82 may be preformed of a thermally conductive material such as a metal of choice. The aforementioned optional diffuser 104 fits around the bottom of the head unit 24 and diffuses the light generated by the light emitting elements 102 to avoid annoying or distracting anyone looking at the movable barrier operator 10 when in operation.

Although the embodiments shown in FIGS. 3 and 4 illustrate a head unit 24 in which the light emitting elements 102 are disposed on the bottom side of a plate 100 within the head unit 24 and the diffuser 104 resides below the light emitting elements, it should be appreciated that different arrangements of the light emitting elements 102 may be utilized in other embodiments, depending on system and lighting requirements.

Figure 5:
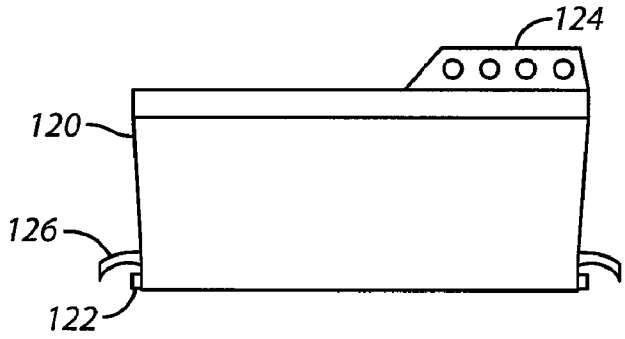
FIG. 5 illustrates a side view of a head unit having reflectors according to an embodiment of the invention.

FIG. 5 illustrates a side view of a head unit 120 having reflectors 126 according to an embodiment of the invention. The head unit 120 may implement functions similar, or the same, as the head unit 24 described above with respect to FIGS. 1-4. The head unit 120 includes light emitting elements 122 disposed on opposite sides of a body of the head unit 120. Each of the light emitting elements 122 may be mounted onto one or more heat sinks or plates capable of conducting heat. The plates may be in thermal communication with the chassis 124 of the movable barrier operator to dissipate heat from the light emitting elements 122.

Only two light emitting elements 122 are shown in FIG. 5. However, a person of ordinary skill would readily appreciate that many additional light emitting elements 122 may also be utilized. The light emitting elements 122 may be disposed physically close to each other to concentrate their generated light. Alternatively, the light emitting elements 122 may be spaced apart. In some embodiments, the light emitting elements 122 are disposed only on the sides of the head unit 120. In other embodiments, the light emitting elements 122 are disposed along more than two sides, such as on all sides of a perimeter of the body of the head unit 120.

In the embodiment shown in FIG. 5, reflectors 126 are utilized to spread the light generated by the light emitting elements 122 and to reflect the light back down onto an area near the movable barrier operator, such as the area below the movable barrier operator. In some embodiments, the light emitting elements 122 may face in the direction of the reflectors 126 so that the reflectors 126 spread the reflected light as much as possible. The reflectors 126 may be formed of a reflective material, such as a reflective metal or a mirror.

Figure 6:
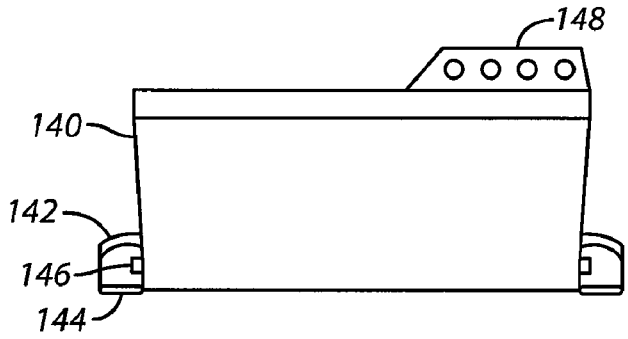
FIG. 6 illustrates a side view of a head unit having reflectors and diffusers according to an embodiment of the invention.

FIG. 6 illustrates a side view of a head unit 140 having reflectors 142 and diffusers 144 according to an embodiment of the invention. The head unit 140 may implement functions similar, or the same, as the head units 24 and 120 described above with respect to FIGS. 1-5. The head unit 140 includes light emitting elements 146 disposed on opposite sides of a body of the head unit 140. Each of the light emitting elements 146 may be mounted onto one or more plates capable of conducting heat. The plates may be in thermal communication with the chassis 148 of the movable barrier operator to dissipate heat from the light emitting elements 146.

The head unit 140 includes diffusers 144 disposed below the light emitting elements 146 and the reflectors 142 to diffuse the light from the light emitting elements 146 in addition to the light reflected by the reflectors 142. Only two light emitting elements 146 are shown in FIG. 6. However, a person of ordinary skill would readily appreciate that many additional light emitting elements may also be utilized. As with the embodiment shown in FIG. 5, the light emitting elements 146 may be disposed physically close to each other to concentrate their generated light. Alternatively, the light emitting elements 146 may be spaced apart. In some embodiments, the light emitting elements 146 are disposed only on the sides of the head unit 140. In other embodiments, the light emitting elements are disposed along all sides of a perimeter of the body of the head unit 140.

Figure 7:
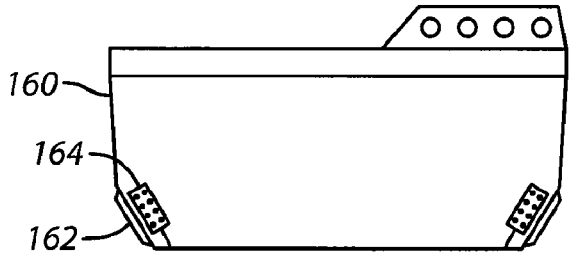
FIG. 7 illustrates a side view of a head unit having lenses for directing light generated by permanently mounted light emitting elements according to an embodiment of the invention.

FIG. 7 illustrates a side view of a head unit 160 having lenses 162 for directing light generated by permanently mounted light emitting elements 164 according to an embodiment of the invention. Each lens 162 is placed in front of one or more light emitting elements 164. The lenses 162 are utilized to spread (or to focus) the light generated by the light emitting elements 164. In the event that the light emitting elements (such as LEDs) generate a bright point of light, the lenses 162 are utilized to spread the light to minimize the chances of a bright point of light being emitted from the head unit that will be distracting or annoying to a driver or other person within or entering the enclosure in which the movable barrier operator is mounted.

Only two light emitting elements 164 are shown in FIG. 7. However, a person of ordinary skill in the art would readily appreciate that many additional light emitting elements may also be utilized. As with the embodiments shown in FIGS. 5 and 6, the light emitting elements 164 may be disposed physically close to each other to concentrate their generated light. Alternatively, the light emitting elements 164 may be spaced apart. In some embodiments, the light emitting elements 164 are disposed only on the sides of the head unit 160. In other embodiments, the light emitting elements 164 are disposed along more than two sides, such as along all sides of a perimeter of the body of the head unit 160.

It should be appreciated that modifications within the spirit of the invention may be made to the embodiments described above. The head unit may include light emitting elements disposed on three sides of the chassis of the head unit. The set of light emitting elements may alternatively be disposed on the head unit to generate a cone of light beams in less than about a 180 degree arc on a second surface beneath the head unit.

The teachings discussed herein provide for a durable movable barrier operator that can be readily installed by a user. Once installed, the user will generally never have to replace the lights within the movable barrier operator because such lights are permanently installed therein. The permanently installed lights generate heat and are in thermal communication with a chassis of the movable barrier operator to dissipate the generated heat, to ensure proper operation of the permanently installed lights.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. For example, if desired, light emitting elements having differing emitted light colors can be used. By one approach, for example, red lighting might be used under some operating circumstance to avoid impairing an end user's night vision while white lighting is used under other operating circumstances. It would also be possible for the movable barrier operator to monitor ambient temperature conditions local to some or all of the light emitting elements. In such a case, the movable barrier operator could then selectively deactivate one or more of the light emitting elements when that temperature exceeded some threshold value of concern to thereby aid in preserving the long term functionality of the light emitting elements while still preserving some degree of present functionality.

We claim:

1. A barrier movement operator for controlling movement of a moveable barrier, the barrier movement operator comprising:

a head unit, including a chassis, for commanding the moveable barrier to perform moveable barrier functions;

a plurality of light emitting elements permanently installed onto the head unit;

a heat sink in thermal communication with the plurality of light emitting elements and with the chassis of the barrier movement operator to dissipate thermal energy from the plurality of light emitting elements;

a controller for controlling the head unit to provide power to the plurality of light emitting elements; and a light diffuser permanently installed on the head unit adjacent the plurality of light emitting elements to diffuse light generated by the plurality of light emitting elements.

2. The barrier movement operator of claim 1, wherein the plurality of light emitting elements comprise Light Emitting Diodes.

3. The barrier movement operator of claim 2, wherein the light diffuser is permanently installed on the head unit above the plurality of light emitting elements to diffuse light generated by the plurality of light emitting elements.

4. The barrier movement operator of claim 2, wherein the light diffuser is permanently installed on the head unit below the plurality of light emitting elements to diffuse light generated by the plurality of light emitting elements.

5. The barrier movement operator of claim 2, wherein the Light Emitting Diodes are disposed around the chassis of the head unit.

6. The barrier movement operator of claim 5, wherein the Light Emitting Diodes are disposed on three sides of the chassis of the head unit.

7. The barrier movement operator of claim 1, further comprising at least one reflector to spread light generated by the plurality of light emitting elements.

8. The barrier movement operator of claim 1, further comprising at least one lens to focus light generated by the plurality of light emitting elements.

9. The barrier movement operator of claim 1, wherein the plurality of light emitting elements are disposed on the head unit to generate a cone of light beams in less than about a 180 degree arc on a surface beneath the head unit.

10. A barrier movement operator for controlling movement of a moveable barrier, the barrier movement operator comprising:

a head unit, including a chassis, for commanding the moveable barrier to perform moveable barrier functions;

a plurality of Light Emitting Diodes permanently installed onto the head unit;

a diffuser permanently installed on the head unit to spread light generated by the plurality of Light Emitting Diodes; and a controller for controlling the head unit to provide power to the plurality of Light Emitting Diodes.

11. The barrier movement operator of claim 10, further comprising a heat sink in thermal communication with the plurality of Light Emitting Diodes and with the chassis of the barrier movement operator to dissipate thermal energy from the plurality of Light Emitting Diodes.

12. The barrier movement operator of claim 10, wherein the plurality of Light Emitting Diodes are disposed around the chassis of the head unit.

13. The barrier movement operator of claim 10, wherein the plurality of Light Emitting Diodes are disposed on three sides of the chassis of the head unit.

14. The barrier movement operator of claim 10, wherein the diffuser comprises at least one lensing element to direct light generated by the plurality of Light Emitting Diodes.

15. The barrier movement operator of claim 14, wherein the diffuser is mounted above the plurality of Light Emitting Diodes and directs the light in a general direction away from of the plurality of Light Emitting Diodes.

16. The barrier movement operator of claim 15, wherein a second diffuser is mounted below the plurality of Light Emitting Diodes and directs the light in a general direction away from the plurality of Light Emitting Diodes.

17. The barrier movement operator of claim 14, wherein the diffuser is mounted below the plurality of Light Emitting Diodes and directs the light in a general direction away from the plurality of Light Emitting Diodes.

18. The barrier movement operator of claim 10, wherein the plurality of Light Emitting Diodes are disposed on the chassis to generate a cone of light beams in less than about a 180 degree arc on a surface beneath the chassis.

19. A method for controlling power to a plurality of Light Emitting Diodes permanently installed on a chassis of a head unit of a movable barrier operator controlling movement of a moveable barrier, the method comprising:

commanding the moveable barrier to perform moveable barrier functions;

providing power to the plurality of Light Emitting Diodes permanently installed on the chassis;

dissipating thermal energy from the plurality of Light Emitting Diodes via the chassis;

controlling the head unit to provide power to the plurality of Light Emitting Diodes;

diffusing light generated by the plurality of Light Emitting Diodes using a diffuser permanently installed to the head unit.

20. The method of claim 19, further comprising generating, via the plurality of Light Emitting Diodes, a cone of light beams in less than about a 180 degree arc on a surface beneath the chassis.

21. The method of claim 19, further comprising spreading light generated by the plurality of Light Emitting Diodes.

* * * * *

UNITED STATES PATENT AND TRADEMARK OFFICE

CERTIFICATE OF CORRECTION

PATENT NO. : 7,862,209 B2
APPLICATION NO. : 11/971718
DATED : January 4, 2011
INVENTOR(S) : James J. Fitzgibbon et al.

It is certified that error appears in the above-identified patent and that said Letters Patent is hereby corrected as shown below:

IN THE CLAIMS:

Claim 15, Column 10, Line 2: Change "of the plurality" to -- the plurality --.

Signed and Sealed this
Twentieth Day of May, 2014

Michelle K. Lee

Michelle K. Lee
*Deputy Director of the United States Patent and Trademark Office*